US010035038B2

(12) United States Patent
Prince et al.

(10) Patent No.: US 10,035,038 B2
(45) Date of Patent: Jul. 31, 2018

(54) PORTABLE REHABILITATIVE TRAINING DEVICE

(71) Applicants: William Chad Prince, Oxford, AL (US); Perry Lee Kerr, Munford, AL (US)

(72) Inventors: William Chad Prince, Oxford, AL (US); Perry Lee Kerr, Munford, AL (US)

(73) Assignee: William Chao Prince, Oxford, AL (US)

( * ) Notice: Subject to any disclaimer, the term of this patent is extended or adjusted under 35 U.S.C. 154(b) by 123 days.

(21) Appl. No.: 15/244,968

(22) Filed: Aug. 23, 2016

(65) Prior Publication Data

US 2018/0056110 A1 Mar. 1, 2018

(51) Int. Cl.

| | |
|---|---|
| ***A63B 22/00*** | (2006.01) |
| ***A63B 21/16*** | (2006.01) |
| ***A63B 21/00*** | (2006.01) |
| ***A63B 23/035*** | (2006.01) |
| ***A63B 23/12*** | (2006.01) |

(52) U.S. Cl.

CPC ..... *A63B 21/1636* (2013.01); *A63B 21/4027* (2015.10); *A63B 21/4033* (2015.10); *A63B 23/03508* (2013.01); *A63B 23/03525* (2013.01); *A63B 23/12* (2013.01); *A63B 2225/09* (2013.01); *A63B 2225/093* (2013.01); *A63B 2225/10* (2013.01)

(58) Field of Classification Search

None

See application file for complete search history.

(56) References Cited

U.S. PATENT DOCUMENTS

| | | | | |
|---|---|---|---|---|
| 2,562,622 A * | 7/1951 | Laughlin | ..... | A47G 25/746 211/100 |
| 2,823,918 A | 2/1958 | Lewis | | |
| RE28,845 E | 6/1976 | Ratchford | | |
| 4,065,995 A | 1/1978 | Greer | | |
| 4,109,794 A * | 8/1978 | Samuel | ..... | A47G 25/746 211/100 |
| 4,198,044 A * | 4/1980 | Holappa | ..... | A63B 21/04 482/130 |

(Continued)

*Primary Examiner* — Stephen R Crow

(74) *Attorney, Agent, or Firm* — Christopher R. Ganter, LLC

(57) ABSTRACT

The present invention is a portable rehabilitative training device comprising a board that has a greater length than its width with alternating parallel rungs and grooves formed in the board that run up and down the boards length is its front surface for use with a person's hands and fingers. The rungs have a flat surface on their top edge and a beveled surface on their bottom edge. The board also has at least one slot formed through the board with such slot being formed in the uppermost groove and also formed in various other groups for purpose of height installation. The slots are used in conjunction with a support strap having a permanent stop formed on one end and the other end has a loop end such that a removable stop can be inserted into the strap loop end once it has been inserted through the back of the slot on the finger board such that it advances through the front of the finger board. The finger board is installed on a door by laying the support strap over the top edge of the door and closing the door.

18 Claims, 6 Drawing Sheets

(56) References Cited

U.S. PATENT DOCUMENTS

| | | | | |
|---|---|---|---|---|
| 4,836,531 | A | 6/1989 | Niks | |
| 4,869,379 | A * | 9/1989 | Hawkrige | A47B 61/02 211/100 |
| 5,078,388 | A | 1/1992 | Dempsey, Jr. | |
| 5,156,581 | A | 10/1992 | Chow | |
| 5,209,382 | A * | 5/1993 | Chang | A47G 25/746 211/87.01 |
| 5,549,520 | A | 8/1996 | Grahm | |
| 5,756,914 | A * | 5/1998 | Streibl | G09B 15/06 84/293 |
| 6,110,075 | A | 8/2000 | Woodruff | |
| 6,227,422 | B1 * | 5/2001 | Hansen | A47G 25/743 223/87 |
| 7,037,244 | B2 * | 5/2006 | Svihra | A63B 23/12 482/135 |
| 7,455,185 | B2 * | 11/2008 | Nelson | A47F 7/12 211/13.1 |
| 7,628,740 | B2 | 12/2009 | Harrington | |
| 8,852,058 | B1 | 10/2014 | Hamberis | |
| 9,220,941 | B2 | 12/2015 | Barry | |
| 2006/0038455 | A1 | 2/2006 | Pavwoski | |
| 2016/0144231 | A1 | 5/2016 | Betts | |
| 2018/0056110 | A1 * | 3/2018 | Prince | A63B 21/1636 |

* cited by examiner

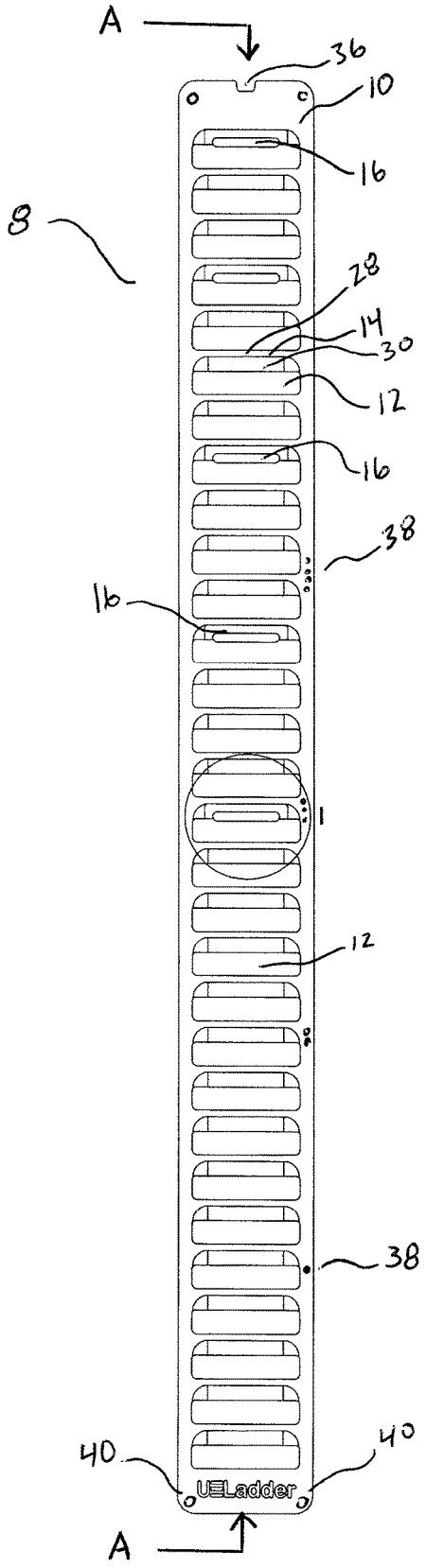
FIG. 1
FIG. 2
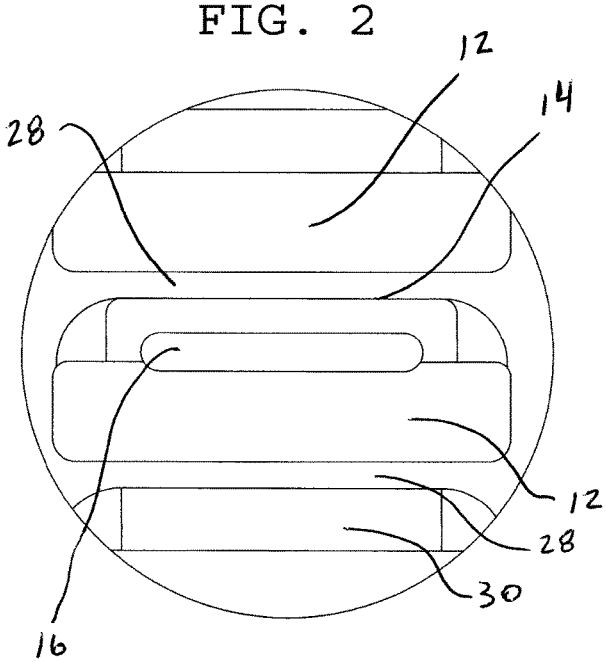

PORTABLE REHABILITATIVE TRAINING DEVICE

CROSS-REFERENCE TO RELATED APPLICATIONS

The instant application claims priority to U.S. Provisional Patent Application Ser. No. 62/208,892 filed on Aug. 24, 2015.

FEDERALLY SPONSORED RESEARCH

None

SEQUENCE LISTING

None

FIELD OF THE INVENTION

The current invention relates to physical rehabilitative therapeutic equipment used for exercising the upper extremity of a person and more particularly to a portable solution for patients such that exercises can be performed at any time outside of a physical therapy facility.

BACKGROUND OF THE INVENTION

Physical rehabilitative thereapeutic equipment is used to treat a person's body by using physical activity through active, passive or active-assistive range of motion stretching. It is a common problem that healthcare providers want to educate patients on home exercise programs, but need equipment in the home to achieve certain exercises. Because therapy equipment is often expensive, and because an episode of care may only last a few months, most patients do not wish to purchase expensive equipment designed for therapy clinics for their homes. This limits a home exercise prescription to either use items that a patient already has in the home, or that uses items that are expensive to purchase.

An extensive line of inexpensive rehabilitation products exists to provide patients with the tools they need for specific home exercises. At present, one piece of equipment utilized in the vast majority of therapy clinics that does not have an inexpensive home-use counterpart is commonly called a finger ladder. The finger ladder is used to provide therapy to a user's upper extremity such as the shoulder, arm, elbow, wrist, hands and/or fingers.

The prior art has illustrated several clinic versions of the finger ladder. All are mounted to the wall with screws and/or anchors. The high entry level price for these finger ladders, added to their design of requiring permanent mounting, makes them impractical for home use. While many healthcare clinicians prescribe finger walking up the wall with no device at all, the full scope of exercises that can be performed on finger ladders in therapy clinics cannot be performed in the home without one. Accordingly, there exists a need for a method and apparatus that provides an inexpensive and portable home version of finger ladders utilized prevalently in therapy clinics.

SUMMARY OF THE INVENTION

The present invention is a finger ladder comprising a board that has a greater length than its width with alternating parallel rungs and grooves formed in the board that run up and down the boards length is its front surface. The rungs have a flat surface on their top edge and a beveled surface on their bottom edge. The board also has at least one slot formed through the board with such slot being formed in the uppermost groove and also formed in various other groups for purpose of height installation. The slots are used in conjunction with a support strap having a permanent stop formed on one end and a loop formed on the other end such that a removable stop can be inserted once the strap loop end has been inserted through the back of the slot on the finger board such that it advances to the front of the finger board.

Specific advantages and features of the present assembly will be apparent from the accompanying drawings and the description of several illustrative embodiments of the present invention.

DESCRIPTION OF THE DRAWINGS

FIG. 1 is a front elevation view of the finger ladder.

FIG. 2 is a detailed view of detail area I of FIG. 1.

DETAILED DESCRIPTION

The invention is generally depicted in FIGS. 1-11 but may be embodied in various other forms. The principles and teachings of the invention, therefore, can be applied to numerous alternative variations.

Figure 9:
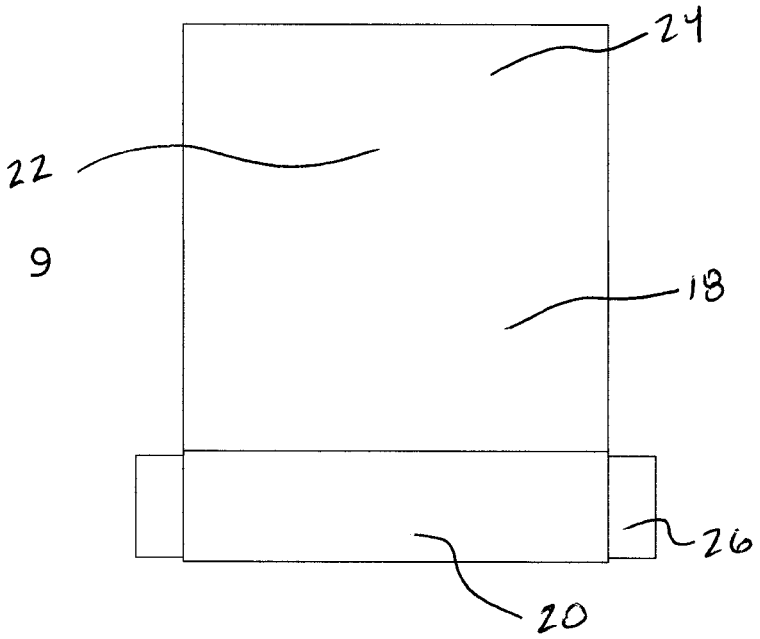
FIG. 9 is a top plan view of the support strap.
Figure 10:
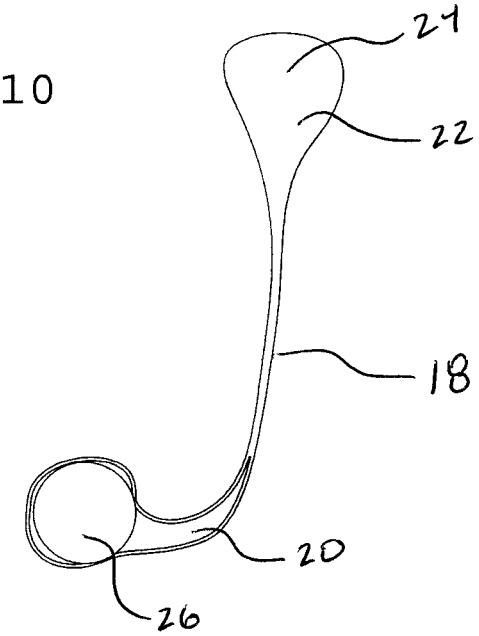
FIG. 10 is a side elevation of the support strap.

Referring now to FIG. 1 there is shown the finger ladder 8 board 10 having alternating grooves 12 and rungs 14 such that they are parallel to each other and perpendicular to the longitudinal axis of the finger ladder 8. The rungs 14 have a flat top edge 28 and a beveled bottom edge 30. The beveled bottom edge 30 aids and allows a user to insert their fingers into the groove 12 without encountering obstruction by taking away what would otherwise be a sharp corner edge. Formed in the board is at least one slot 16 for use with a support strap 18 as shown in FIGS. 9 & 10. The slots 16 can be formed in the upper region of the board 10 or can be formed within the grooves 12 located on the board 10. A slot 16 formed in a groove 12 would be formed in the beveled bottom edge 30 of a rung 14 whereby a cutout 32 would be cut out of the beveled bottom edge 30. As shown, the slots 16 can be spaced apart so that it allows a user to adjust the height at which the finger ladder 8 will attach to a door edge when closed. Also shown in FIG. 1 are dimple markers 38 which give a user visual or touch confirmation of how many rungs 14 on the finger ladder 8 have been climbed or at what position they currently are in accordance to a therapeutic treatment plan. In one embodiment, the dimple markers 38 are located at every fifth rung 14 and are multiples of consecutive five rungs 14.

There are also shown apertures 40 in the corners of the ladder 8 that can be used with means to install the finger ladder 8 to permanently mount the finger ladder 8 with fasteners such as screws or nails. Additionally, there can be used cords which run through said apertures 40 and have a stop tied onto them such that when they are inserted over a door top edge and the door is closed the finger ladder 8 is suspended from the top of the door by the being pinned against the back of the door and the door jamb. These methods of installing the finger ladder 8 are various means by which installation can be accomplished.

The finger ladder 8 can be made of wood, plastic, composite material, metal, carbon fiber and other materials. In a preferred embodiment the finger ladder 8 is made out of wood or plastic such that the grooves 12 can be formed by the process of routing thereby simultaneously producing the grooves 12 and rungs 14. Specifically, hardwood laminate plywood is an ideal choice due to its inexpensive cost, sufficient strength, and ease of manipulation. In one embodiment, the finger ladder 8 is formed from 0.75 inch plywood and is 3.75 inches wide. The rungs are 9/16 inches thick at their base and the flat top edge 28 of the rung is ¼ inch thick. The use of the bottom beveled edge 30 allows the rungs 14 to have adequate strength but to also allow clearance of a user's fingers. The grooves 12 are three inches wide and the side rails of the finger ladder 8 are three-eighths inches thick which allows sufficient rigidity of the finger ladder 8. The ladder 8 has thirty rungs 14 in one embodiment.

Referring now to FIG. 2 there is shown a detailed view of the grooves 12 and 14 rungs and slot 16 whereby the slot 16 is formed through the bottom beveled edge 30 and a cutout 32 is formed into the bottom beveled edge 30 above the slot 16 for insertion of the support strap 18 as shown in FIGS. 9 & 10 through said slot 16 and installing said removable stop 26 into said loop end 20 of the support strap 18 whereby the removable stop 26 surrounded by said loop end 20 are pinned against the cutout 32 when the support strap 18 and finger ladder 8 is installed over a door. This configuration allows for the removable stop 26 and loop end 20 to nest back into the cutout 32 in the bottom beveled edge 30 and above the slot 16 such that it allows for a user's fingers to use that particular groove 12 without encountering the removable stop 26 as an obstacle or obstruction.

Figure 3:
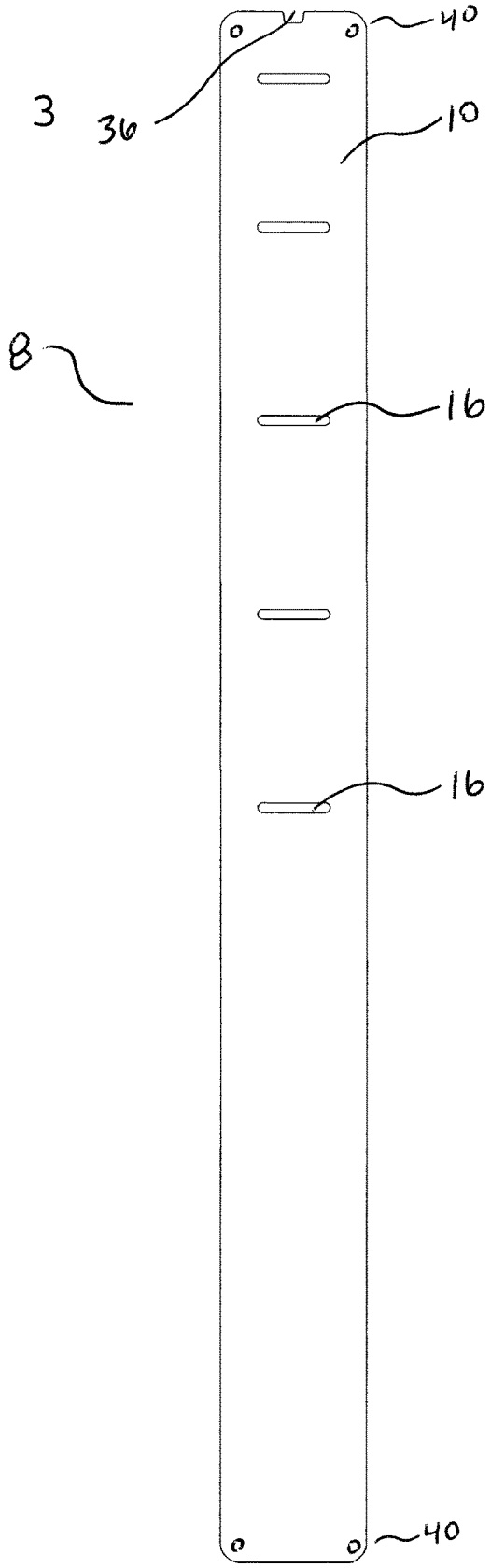
FIG. 3 is a back elevation view of the finger ladder.

Referring now to FIG. 3 there is shown the back of the finger ladder 8 with slots 16 formed through finger ladder 8 and a notch 36 formed into the top edge of the finger ladder 8.

Figure 4:
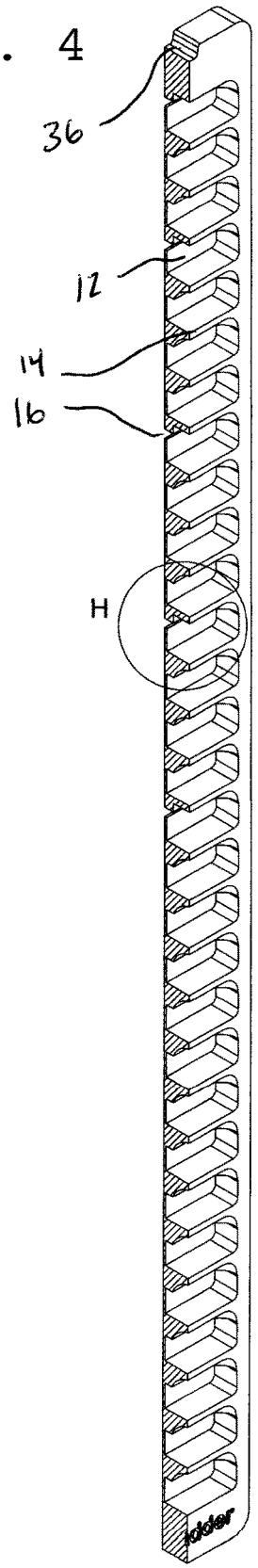
FIG. 4 is a perspective cross-sectional view along the plane A-A as shown in FIG. 1

Referring now to FIG. 4, there is shown a perspective cross sectional view of the finger ladder 8 along plane A-A as shown in FIG. 1. This shows the beveled bottom edge 30 of the rung 14 and how it is formed.

Figure 5:
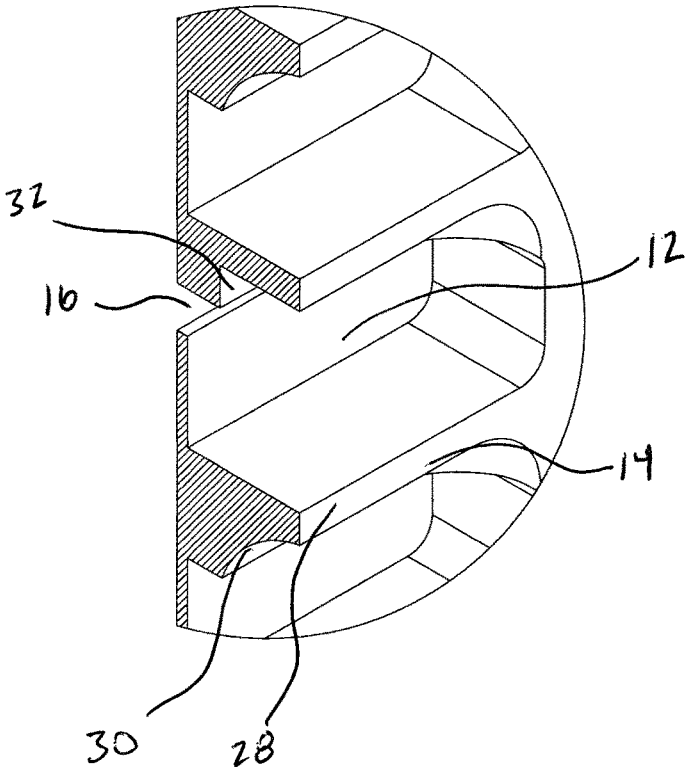
FIG. 5 is a detailed view of detail area H of FIG. 4.

Referring now to FIG. 5, there is shown a detailed view H as shown in FIG. 4 which shows a groove 12, a rung 14, the flat top edge 28 and bottom beveled edge 30 of a rung 14 along with a slot 16 formed in the back of the groove 12.

Figure 6:
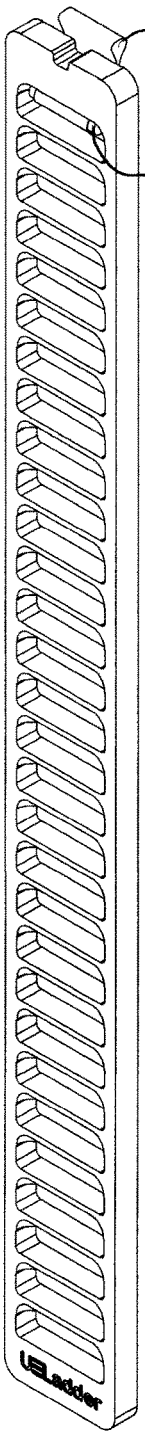
FIG. 6 is a front right perspective view of the finger ladder.
Figure 7:
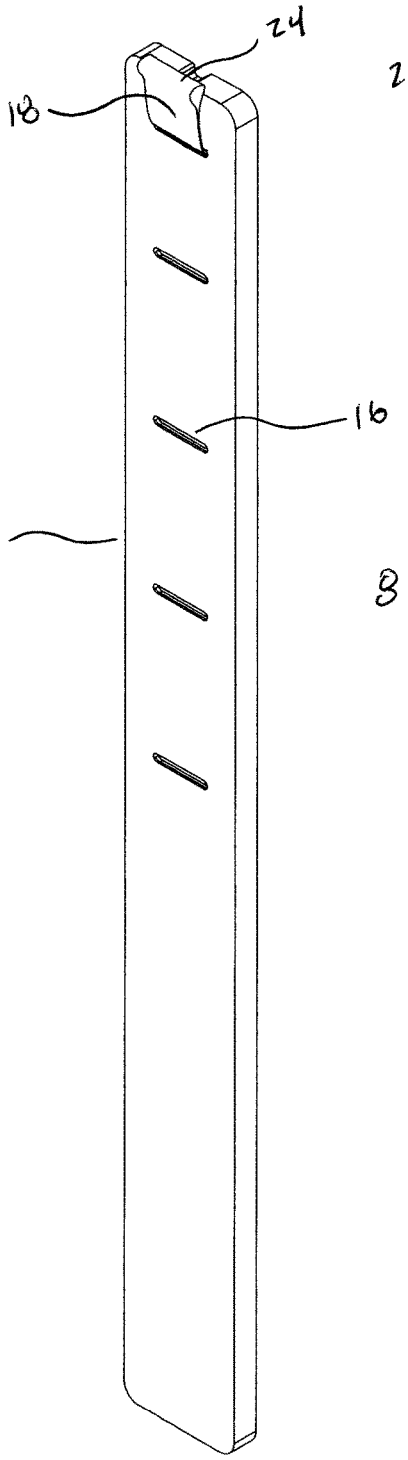
FIG. 7 is a back perspective view of the finger ladder.
Figure 8:
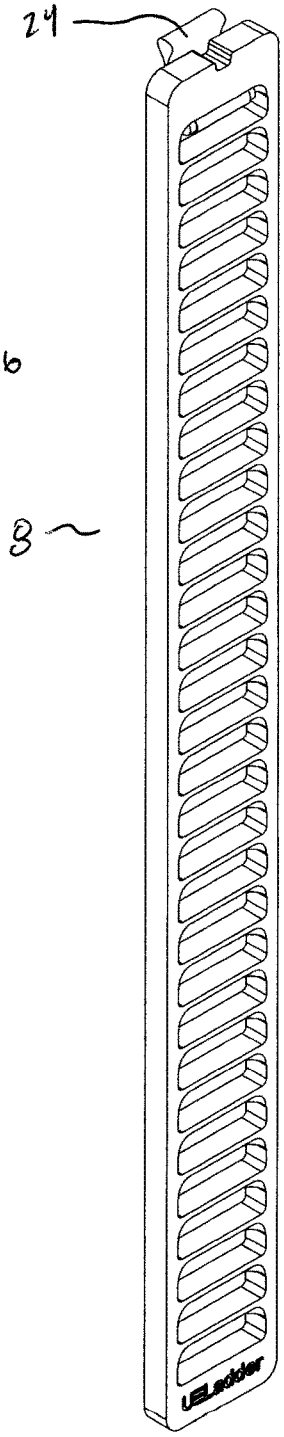
FIG. 8 is a front left perspective view of the finger ladder.

Referring now to FIGS. 6-8, there is shown various perspective views of the finger ladder 8 with the support strap 18 (as shown in FIGS. 9-10) installed into a slot 16 of the finger ladder 8.

Referring now to FIGS. 9-10, there is shown a support strap 18 with a loop end 20 that receives a removable stop 26 on one end of the strap 18 and on the other end of the strap 18 a pocket 22 that house a permanent stop 24. The support strap 18 can be made out of a variety of synthetic fabrics. The strap 18 pocket is formed by sewing a portion of the strap 18 over on itself and then inserting the permanent stop 24 which can be of many different shapes as long as it is wide enough so that it gets pinned against a top edge of a door and a door jamb when inserted over the door and the door is closed. The removable stop 26 is cylindrical or rectangular in shape. In use, the support strap 18 is inserted loop end 20 first into a slot 16 from the rear of the finger ladder 8. The removable stop 26 is not inserted into the loop end 20 until the loop end 20 is pushed through the slot 16. Once the removable stop 26 is inserted into the loop end 20 a user will pull the support strap 8 from the rear so that the removable stop 26 and the loop end are pulled tightly against the cutout 32 formed in the beveled bottom edge 30 of a rung 14 such that it nests against the cutout 32 securely. A user would then take the finger ladder 8 by its base in one hand, locate a door for use thereon, and lay the support strap 18 protruding out of the rear of the finger ladder 8 over the top of a door and then close the door such that the permanent stop 24 is pinned behind the door and against the top of the door and the door jamb. This allows the finger ladder 8 to be used on most any door. A further option a user has is to then slide the finger ladder 8 over against the hinges and side door jamb such that the finger ladder 8 is stable and secure during use as the ladder will pin against the door hinges and door jamb.

Figure 11:
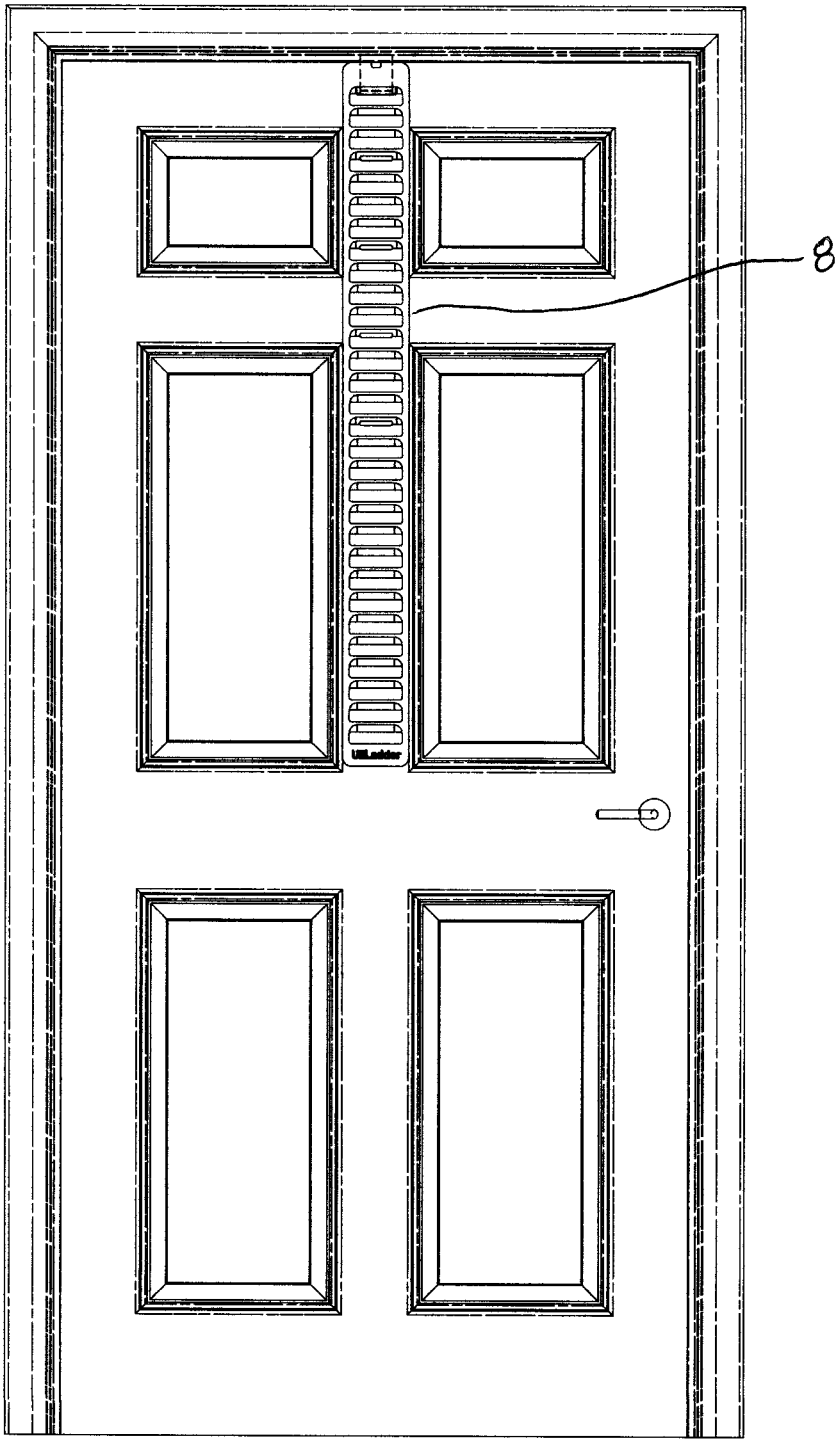
FIG. 11 is a front elevation view of the finger ladder installed on a door.

Referring now to FIG. 11, there is shown the finger ladder 8 installed upon a door.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

What we claim is:

1. A portable rehabilitative training device, comprising:

a board having a length greater than its width;

a plurality of parallel grooves formed in said board such that said grooves advance along the length of the board and wherein said grooves are perpendicular to the longitudinal axis of said board length;

a plurality of parallel rungs that alternate with said grooves;

at least one slot;

a support strap having a loop at one end and a pocket on the opposite end of said strap wherein a stop is permanently installed in said pocket; and a removable stop insertable into said loop.

2. The portable rehabilitative training device of claim 1 wherein the rungs have a flat top edge and a bottom beveled edge.

3. The portable rehabilitative training device of claim 2 wherein there is a cutout formed into the lower beveled edge of a rung where a slot is located to accept the removable stop.

4. The portable rehabilitative training device of claim 1 wherein the board has progress dimples formed on its outer face at strategic positions.

5. The portable rehabilitive training device of claim 1 wherein the strap has a length of 4 to 6 inches.

6. The portable rehabilitative training device of claim 1 further comprising a notch formed in the uppermost edge of the board to aid in installation of therapeutic equipment.

7. The portable rehabilitative training device of claim 1 where the board has apertures formed through its corners for use in conjunction with means for installing said board on a surface.

8. The portable rehabilitative training device of claim 1 where the board has a plurality of slots formed in said grooves for height adjustment of the board.

9. A portable rehabilitative training device, comprising;

a board having a length greater than its width;

a plurality of parallel grooves formed in said board such that said grooves advance along the length of the board and wherein said grooves are perpendicular to the longitudinal axis of said board length;

a plurality of parallel rungs that alternate with said grooves;

a slot;

a support strap having a loop at one end and a pocket on the opposite end of said strap wherein a stop is permanently installed in said pocket;

a removable stop insertable into said loop.

10. The portable rehabilitative training device of claim 9 wherein the rungs have a flat top edge and a bottom beveled edge.

11. The portable rehabilitative training device of claim 10 wherein there is a cutout formed into the lower beveled edge of a rung where the slot is located to accept the removable stop.

12. The portable rehabilitative training device of claim 9 wherein the board has progress dimples formed on its outer face at strategic positions.

13. The portable rehabilitative training device of claim 9 wherein the strap has a length of 4 to 6 inches.

14. The portable rehabilitative training device of claim 1 further comprising a notch formed in the uppermost edge of the board to aid in installation of therapeutic equipment.

15. The portable rehabilitative training device of claim 1 where the board has apertures formed through its corners for use in conjunction with means for installing said board on a surface.

16. A method for rehabilitating an upper extremity comprising the steps of:

providing a portable rehabilitative training device, further comprising:

a board having a length greater than its width;

a plurality of parallel grooves formed in said board such that said grooves advance along the length of the board and where said grooves are perpendicular to the longitudinal axis of said board length;

a plurality of parallel rungs that alternate with said grooves wherein said rungs have a flat top edge and a bottom beveled edge;

at least one slot;

a support strap having a loop at one end and a pocket on the opposite end of said strap wherein a stop is permanently installed in said pocket; and a removable stop insertable into said loop;

identifying an appropriate door to install the portable rehabilitative training device;

inserting the loop end of the strap into a slot on the board from the rear and pulling it through the slot;

inserting the removable stop into the loop and pulling the pocket end of the strap so that the removable stop located in the strap loop nest into the back of the groove;

opening a door a sufficient amount of distance and guiding said board by placing one hand underneath the bottom of the board and the other hand along the side of the board and guiding said board such that the such that the strap and stop located in the pocket are draped over the door and emerge on the opposite side of the door;

closing the door; and performing rehabilitative exercises on said board.

17. The method of claim 16 further comprising the step of sliding the board to the side such that it is pinned against the hinges of a door.

18. The method of claim 16 further comprising the step of relocating the strap into a different slot so that portable rehabilitative training device can be installed at a different height on a door.

* * * * *